US006892818B2

(12) United States Patent
Mentesh et al.

(10) Patent No.: US 6,892,818 B2
(45) Date of Patent: May 17, 2005

(54) INTERCHANGEABLE CHOKE ASSEMBLY

(75) Inventors: Ibrahim M. Mentesh, Roseville, CA (US); Carl R. Baenziger, Roseville, CA (US); Gavin S. Thursfield, Victoria (AU); Steven W. Thompson, Victoria (AU)

(73) Assignee: Carpenter Advanced Ceramics, Inc., Auburn, CA (US)

( * ) Notice: Subject to any disclaimer, the term of this patent is extended or adjusted under 35 U.S.C. 154(b) by 30 days.

(21) Appl. No.: 10/379,097

(22) Filed: Mar. 3, 2003

(65) Prior Publication Data

US 2003/0155130 A1 Aug. 21, 2003

Related U.S. Application Data

(63) Continuation-in-part of application No. 10/130,651, filed as application No. PCT/US00/32150 on Nov. 28, 2000, now Pat. No. 6,662,869.

(51) Int. Cl.[7] ..... E21B 34/02

(52) U.S. Cl. ..... 166/373; 166/91.1; 166/316; 251/122

(58) Field of Search ..... 166/373, 91.1, 166/316; 137/375; 251/122

(56) References Cited

U.S. PATENT DOCUMENTS

| | | | | |
|---|---|---|---|---|
| 2,132,199 | A | | 10/1938 | Yancey |
| 3,985,150 | A | | 10/1976 | Kindersley |
| 4,044,991 | A | | 8/1977 | Waller |
| 4,337,788 | A | | 7/1982 | Seger |
| 4,638,833 | A | * | 1/1987 | Wolcott, II ..... 137/312 |
| 4,664,139 | A | | 5/1987 | Pfeiffer |
| 4,705,062 | A | | 11/1987 | Baker |
| 4,732,364 | A | | 3/1988 | Seger et al. |
| 4,735,229 | A | | 4/1988 | Lancaster |
| 4,926,898 | A | | 5/1990 | Sampey |
| 5,201,491 | A | | 4/1993 | Domangue |
| 5,419,371 | A | | 5/1995 | Berchem |
| 5,707,214 | A | | 1/1998 | Schmidt |
| 6,367,546 | B1 | | 4/2002 | Mentesh et al. |

FOREIGN PATENT DOCUMENTS

| | | |
|---|---|---|
| DE | 3515925 | 11/1986 |
| EP | 0935050 | 8/1999 |

* cited by examiner

*Primary Examiner*—David Bagnell
*Assistant Examiner*—Shane Bomar
(74) *Attorney, Agent, or Firm*—Dann, Dorfman, Herrell and Skillman, P.C.

(57) ABSTRACT

A pressure reducing apparatus and a method of operating a pressure reducing apparatus are provided. The apparatus is operable to reduce the pressure and flow rate of oil being discharged from a well head to downstream processing equipment. The device has central flow channel configured to receive a flow of oil and reduce the pressure in the oil. The apparatus has internal components formed of a ceramic material that resists erosion and wear caused by sand and other debris in the oil. In one embodiment of the invention, a ceramic outer sleeve is disposed in the central flow channel and cooperates with a ceramic inner sleeve having an orifice. The ceramic inner sleeve is interchangeable with other ceramic sleeves having different orifices to modify the pressure and flow characteristics of oil as it is discharged to the downstream processing equipment.

11 Claims, 16 Drawing Sheets

INTERCHANGEABLE CHOKE ASSEMBLY

RELATED APPLICATIONS

This application is a CIP of Ser. No. 10/130,651 now U.S. Pat. No. 6,662,869 filed May 20, 2002 claims priority under 35 U.S.C. §120 from U.S. application Ser. No. 10/130,651, filed as International Application No. PCT/US00/32150 on Nov. 28, 2000, which is hereby incorporated herein by reference.

FIELD OF THE INVENTION

This invention relates generally to flow components for high pressure oil wells, and in particular to the use of ceramic material in wear components for a pressure reducer assembly for such wells.

BACKGROUND

Many oil well facilities around the world operate under high pressure. In other words, the pressure within the well is sufficiently high (e.g., 3000 to 5000 psi) to carry the crude oil to the surface without pumping. Unless restricted, the crude oil flows to the surface at a high velocity and contains sand and other debris which erodes the interior surfaces of the oil well piping components. In order to limit the amount of sand and debris that is carried with the extracted oil, the high well pressure is maintained in the exit piping by using a pressure reducer at the head end of the well. For instance, a six inch inner diameter well pipe is reduced to three inches through a series of harrow channel pipe components. The flow channel is then further reduced to less than one inch, or even less than one-half inch, in the pressure reducer assembly.

The known pressure reducing devices are made of carbon steel and have tungsten carbide inserts to line the inside surfaces of the flow channels. The abrasive oil-and-sand mixture not only wears away the inside wall of the flow channels, but also backwashes around the outside diameter of the flow reducer and wears away the steel body of the flow reducer, resulting in gross failure of the reducer itself. Often, the metal housing surrounding the flow reducer is severely worn as well. Continuous erosion of the pressure reducer over time results in a slow and continuous loss of desired operating pressure until gross failure requires replacement. This loss in operating pressure causes an ever-increasing sand content, resulting in less efficient oil production. Eventually, the oil line must be shut off, and the entire pressure reducer device must be disconnected from the line and replaced.

The average life of known flow reducers is about 4 to 12 weeks. Oil well downtime to replace a pressure reducer and/or other components, is usually four to eight hours. Since high pressure oil wells typically produce about 5,000 to 12,000 barrels of oil a day, the downtime associated with replacement of a pressure reducer can result in a significant loss of oil production. It is readily apparent that the present construction of oil well pressure reducing assemblies leaves something to be desired with respect to wear resistance and useful life.

SUMMARY OF THE INVENTION

In a first aspect of the present invention, a pressure reducing device is provided that has an extended operating life. The internal components of the device are made entirely of ceramic materials that minimize abrasive wear caused by sand and other debris in oil. In one embodiment of the invention, a fixed choke is provided to reduce pressure in the exit piping of an oil line. The device has a hollow body having an inlet opening, an outlet opening and a central flow channel between the inlet opening and the outlet opening. A first liner is disposed in the inlet opening, and a second liner is disposed in the outlet opening. An outer sleeve is disposed in the central flow chamber and cooperates with an inner sleeve having an orifice. The inner sleeve is interchangeable with other sleeves having different orifices to modify the pressure and flow of oil as it is discharged from the device to oil processing equipment.

In a second aspect of the present invention, a method for operating a pressure reducing assembly in accordance with the first aspect of the invention is provided. A pressure reducing assembly is provided having hollow body and a central flow channel formed therein. A wear resistant outer sleeve formed of a ceramic material is placed in the central flow channel. A first inner sleeve is then inserted in the outer sleeve. The first inner sleeve is operable to discharge oil from the pressure reducing assembly at a first pressure and a first flow rate. The first sleeve is removed from the outer sleeve and replaced with a second inner sleeve, which is operable to discharge oil from the pressure reducing assembly at a second pressure and a second flow rate.

DESCRIPTION OF THE DRAWINGS

The foregoing summary as well as the following description will be better understood when read in conjunction with the figures in which.

DETAILED DESCRIPTION OF THE PREFERRED EMBODIMENT

Figure 1:
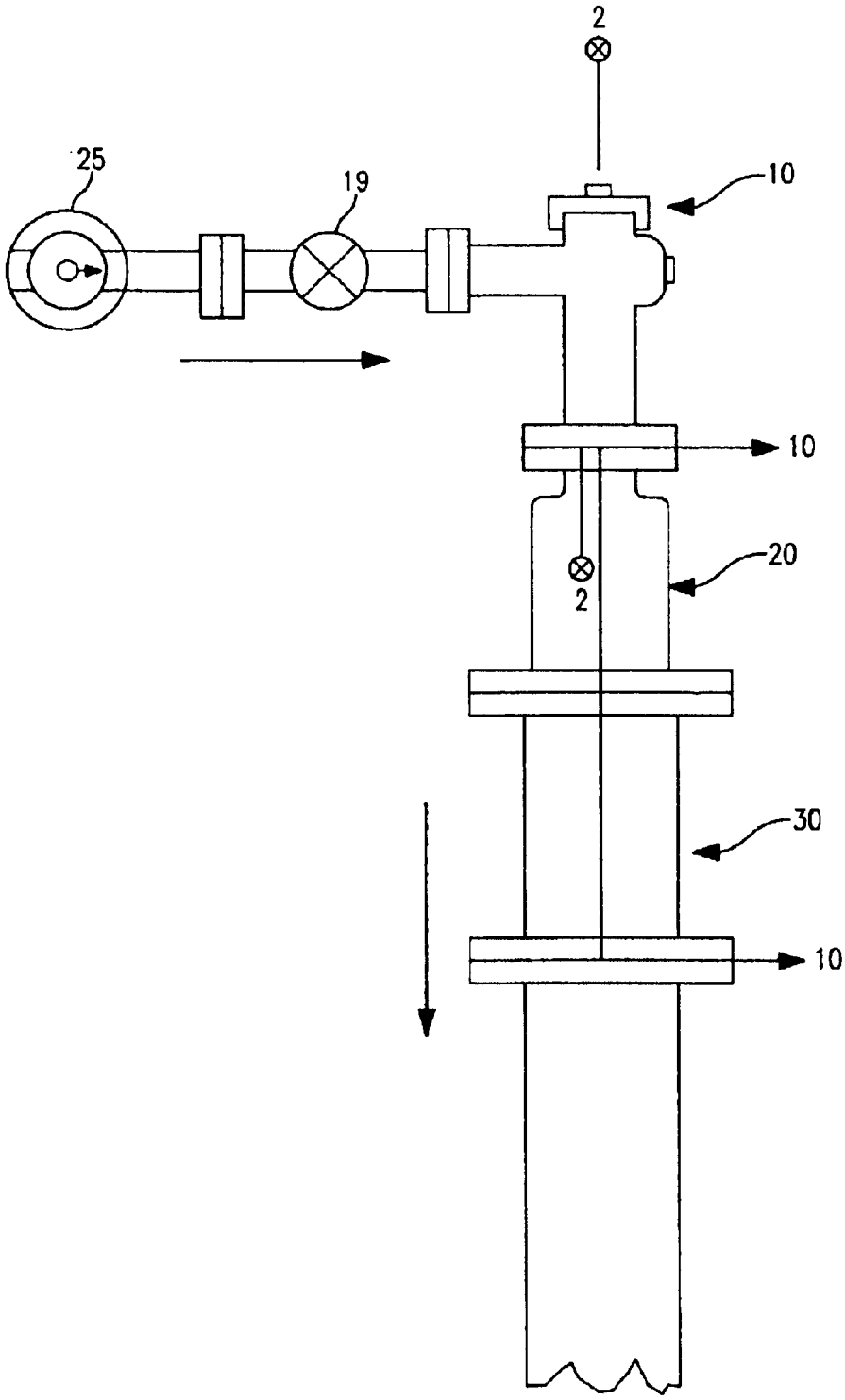
FIG. 1 is a side elevation view of a pressure reducing assembly for a high pressure oil well.

Referring now to the drawings wherein like reference numerals indicate identical or corresponding parts among the several views and in particular to FIG. 1, there is shown a pressure reducing assembly for a high-pressure well head. For purposes of orientation, the oil flow originating from the well flows through the pressure reducing assembly according to the present invention and toward the oil process piping in the direction shown by the arrows. A pressure reducing valve 10 is connected through an isolation valve 19 to a well head manifold 25. The downstream side of pressure reducing valve 10 is connected to a first spool adapter 20, which is connected to a second spool adapter 30. The second spool adapter 30 is connected to the piping that leads to the oil processing facilities (not shown).

Figure 2:
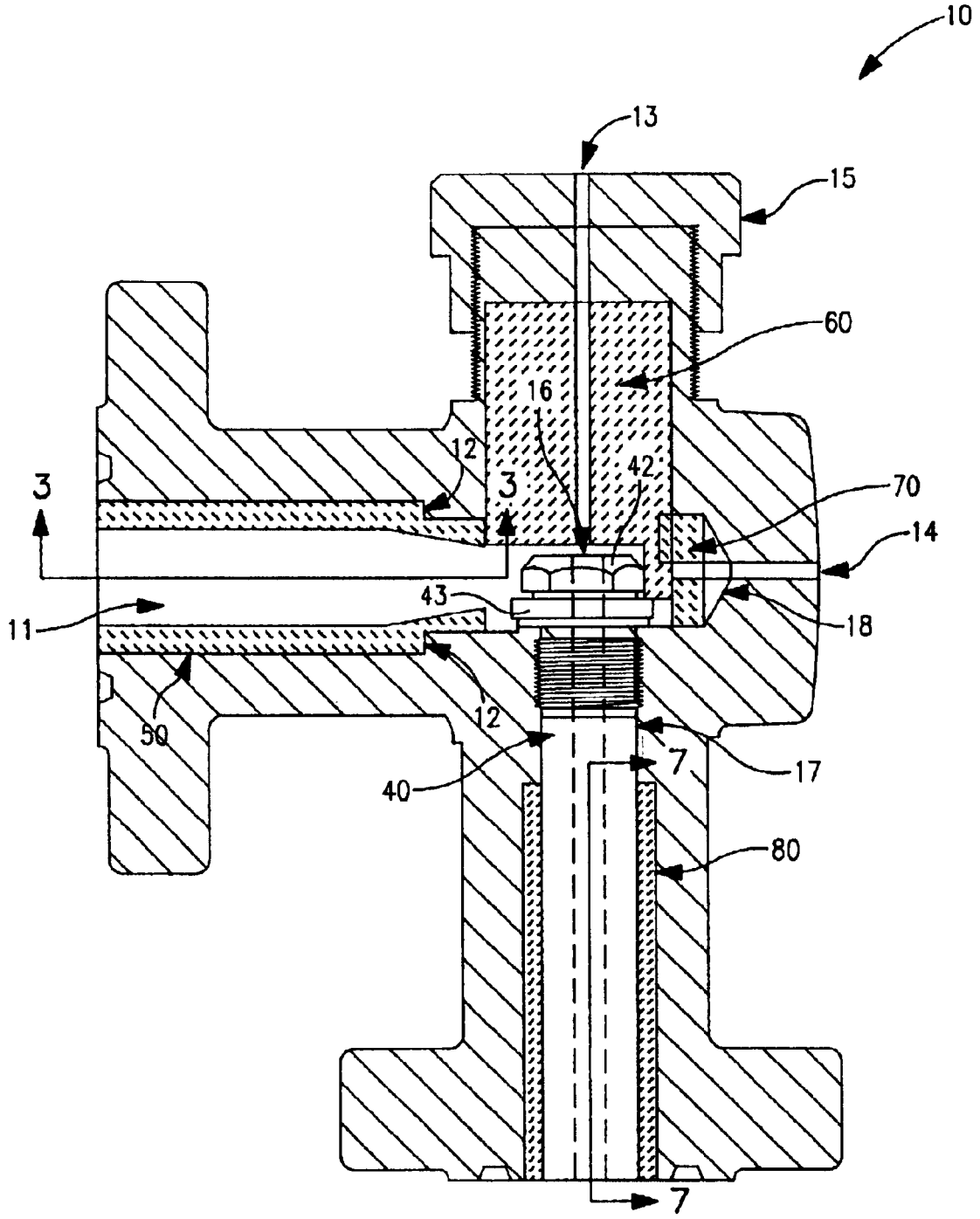
FIG. 2 is a side elevation view in partial cross section showing the interior of the pressure reducing valve of FIG. 1 as viewed along line 2—2 thereof.

Referring now to FIG. 2, the pressure reducing valve 10 has a metallic body that includes an upstream channel 11, a direction-changing cavity 16, a downstream channel 17, and a key-plate recess 18. A pressure reducer 40 is disposed in the downstream channel 17 and has a hex head 42 and a sealing shoulder 43 that extend into the direction-changing cavity 16, adjacent the upstream channel 11. An upstream channel liner 50 is disposed in the upstream channel 11 and a downstream channel liner 80 is disposed in the downstream channel 17. The channel liners 50 and 80 prevent erosion of the inner walls of the channels 11 and 17, respectively, by the oil/sand mixture flowing from the oil well. A direction-changing cavity liner 60 is situated in the direction-changing cavity 16 to prevent erosion and wear of the inner wall of the direction changing cavity 16. A key plate liner 70 is disposed in a key-plate recess 18 situated at an end of the direction-changing cavity 16 adjacent the downstream channel 17. The key plate liner 70 prevents erosion and wear of the metal wall of the key-plate recess 18.

An end cap 15 is provided to close off the direction changing cavity 16. The end cap 15 is removable to permit access to the direction changing cavity 16 for installing and removing the direction changing cavity liner 60 and the key plate liner 70. The end cap 15 can be unthreaded and removed to provide access to direction changing cavity 16. The direction changing cavity liner 60 is removed by sliding it out of the direction changing cavity 16. Once the direction changing cavity liner 60 is removed, the key plate liner 70 can be removed by tilting it out of key plate recess 18 and pulling it through the directional changing cavity 16 and out of the access opening. When the direction changing cavity liner 60 and the key plate liner 70 are removed, the hex head 42 of the pressure reducer 40 is accessible for removal or installation of the pressure reducer 40.

End cap 15 has a port 13 formed therethrough to provide a connection point for a pressure gauge or other pressure sensing device. A second port 14 is formed in the body of pressure reducing valve 10 adjacent to the key-plate recess 18 to provide a connection point for a second pressure gauge or sensing device.

Figure 3:
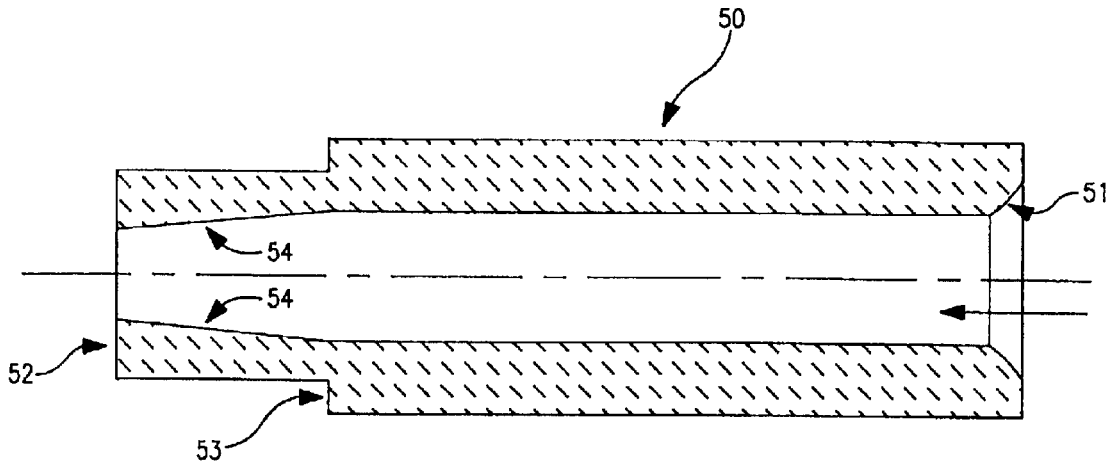
FIG. 3 is a cross-sectional side view of a ceramic liner used in the upstream channel of the pressure reducing valve of FIG. 2, as viewed along line 3—3 thereof.

The upstream channel 11 is generally cylindrical and has an inlet portion characterized by a first diameter and an outlet portion 52 that is characterized by a second diameter smaller than the first diameter. The inlet portion and the outlet portion meet at an upstream channel maintenance point 12 which serves as a stop for the upstream channel liner 50. Referring now to FIG. 3, there is shown an upstream channel liner 50 in accordance with the present invention. The upstream channel liner 50 is generally cylindrical and has an inlet portion and an outlet portion. The inlet portion has a diameter that is essentially commensurate with the inside diameter of the inlet portion of upstream channel 11 and the outlet portion has an outside diameter that is essentially commensurate with the inside diameter of the outlet portion of upstream channel 11. That arrangement provides a shoulder stop 53 on the exterior of the upstream channel liner 50 which abuts the upstream channel maintenance point 12 when inner end 52 is inserted into the upstream channel 11. The abutment of the shoulder stop 53 with the maintenance point 12 prevents the liner from shifting toward the direction changing cavity 16 when oil is flowing. The upstream channel liner 50 has an internal channel that extends from an opening 51 to the outlet portion 52. The opening is preferably flared to lessen flow turbulence as the oil enters the upstream channel liner 50. In the embodiment shown in FIG. 3, the internal channel tapers to a smaller cross section as it traverses the outlet portion 52. The tapered channel portion 54 relieves some of the pressure and turbulent flow of the oil as it flows through the upstream channel 11. The upstream channel liner 50 is formed of a ceramic material.

Figure 4:
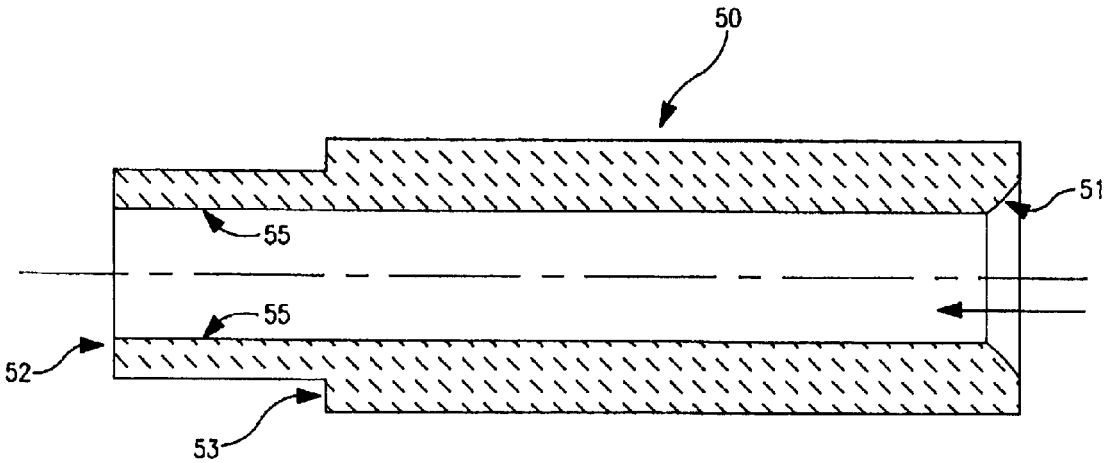
FIG. 4 is a cross-sectional side view of an alternative embodiment of the ceramic liner shown in FIG. 3.

Shown in FIG. 4 is an alternative embodiment of the upstream channel liner 50. In the embodiment shown in FIG. 4, the internal channel 55 has a uniform cross section to maximize flow.

Figure 5A:
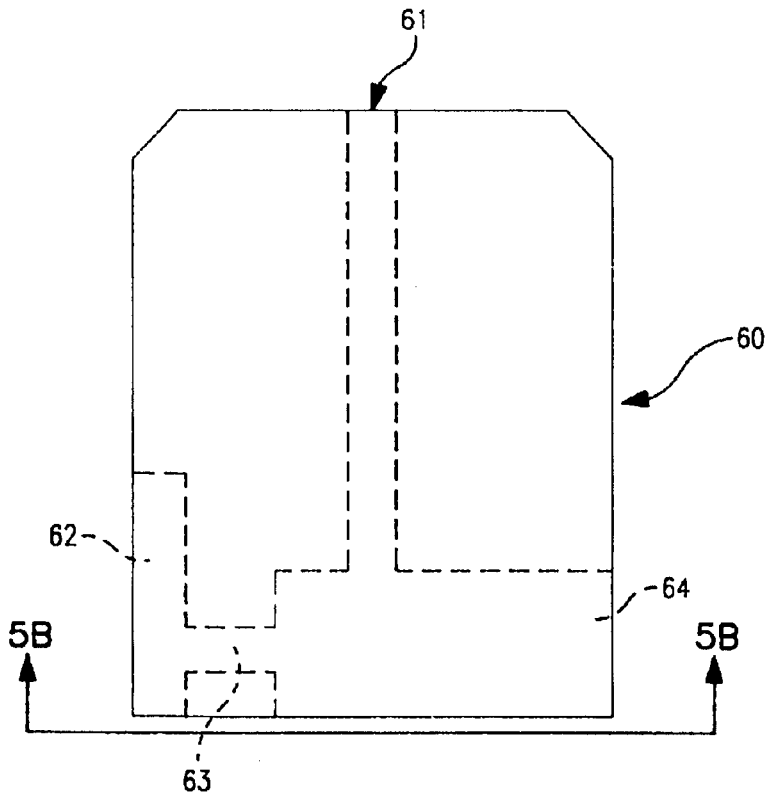
FIG. 5A is side view of a direction changing cavity liner used in the pressure reducing valve shown in FIG. 2.
Figure 5B:
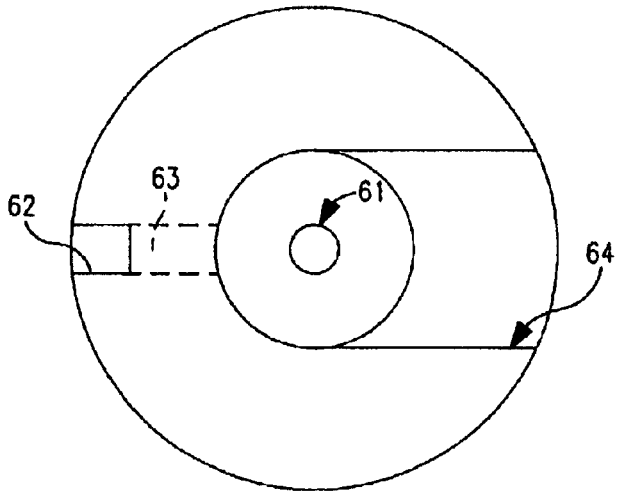
FIG. 5B is an end view of the direction changing cavity liner shown in FIG. 5A as viewed along line 5B—5B thereof.

Referring now to FIGS. 2, 5A, and 5B, the direction changing cavity liner 60 is disposed within the directional changing cavity 16 of pressure reducing valve 10. The directional changing cavity liner 60 is formed of a ceramic material. The liner 60 is generally cylindrical and has an outside diameter that is dimensioned to provide a snug fit between the outer surface of the liner 60 and the inner surface of the cavity 16. A recess 64 is formed in one end of the liner 60. The recess is dimensioned to provide a space around the head 42 and shoulder 43 of the pressure reducer 40 when it is fully threaded into the downstream channel 17. A central through-hole 61 extends along the length of the direction changing cavity liner 60 to provide a path between the recess 64 and the port 13 for pressure indication. The directional changing cavity liner 60 has a key-way 62 formed thereon which extends longitudinally partially along the exterior of direction changing cavity liner 60. The directional changing cavity liner 60 also has a key plate thru-hole 63 formed therein between the recess 64 and the key-way 62 to provide fluid communication between recess 64 and port 14.

Figure 6B:
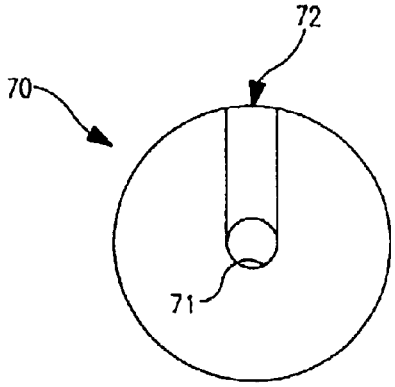
FIG. 6B is an end view of the key plate liner shown in FIG. 6A as viewed along line 6B—6B thereof.
Figure 6A:
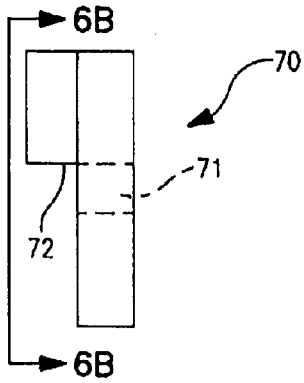
FIG. 6A is a side view of a key plate liner used in the pressure reducing valve shown in FIG. 2.

Referring now to FIGS. 2, 6A, and 6B, the key plate liner 70 is positioned within the key plate recess 18 of reducing valve 10. Key plate liner 70 contains a key plate thru-hole 71 which aligns with the key plate port 14 and the key plate thru-hole 63 to provide fluid communication between the recess 64 and the key plate port 14. Key plate liner 70 also has a key 72 formed thereon which is dimensioned to mate with the key-way 62 in liner 60 to ensure proper alignment of the key plate liner 70 and the cavity liner 60. The key plate liner 70 is formed of a ceramic material.

Figure 7:
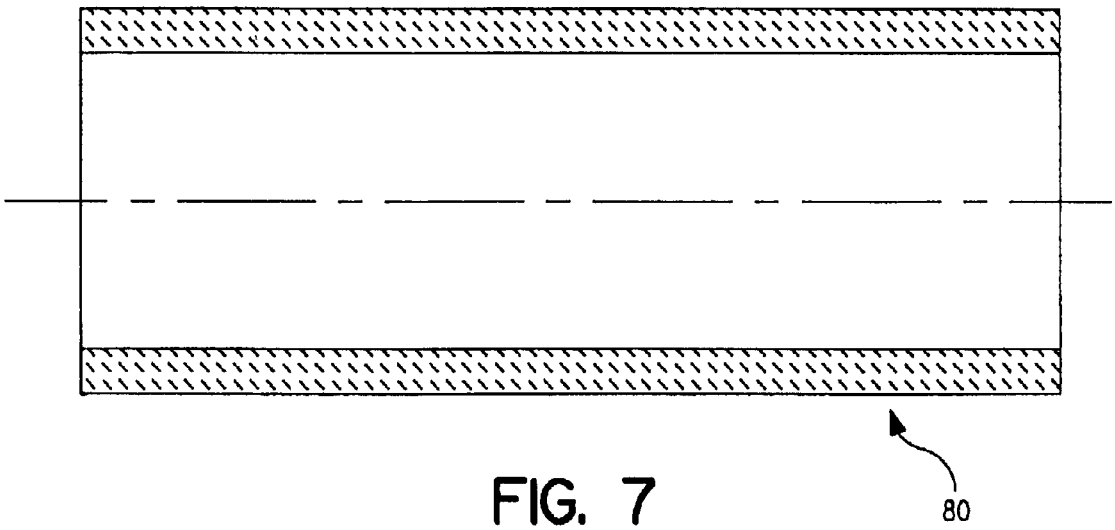
FIG. 7 is a cross-sectional side view of a downstream cylindrical liner used in the pressure reducing valve of FIG. 2, as viewed along line 7—7 thereof.

Referring now to FIGS. 2 and 7, the downstream channel liner 80 is disposed within the downstream channel 17. The downstream channel 80 is generally cylindrical in shape and has an outside diameter that is dimensioned to provide a tight fit with the downstream channel 17. Because of that arrangement, the downstream liner 80 prevents the oil from backwashing between the liner and the interior wall of downstream channel 17. The downstream channel 80 extends less than the full length of the downstream channel 17 so that an attachment region is provided where the pressure reducer 40 can be attached to the body of the pressure reducing valve 10. In the embodiment shown, the pressure reducer 40 is attached by threading it into the downstream channel 17. The downstream channel liner 80 is formed of a ceramic material.

Figure 8:
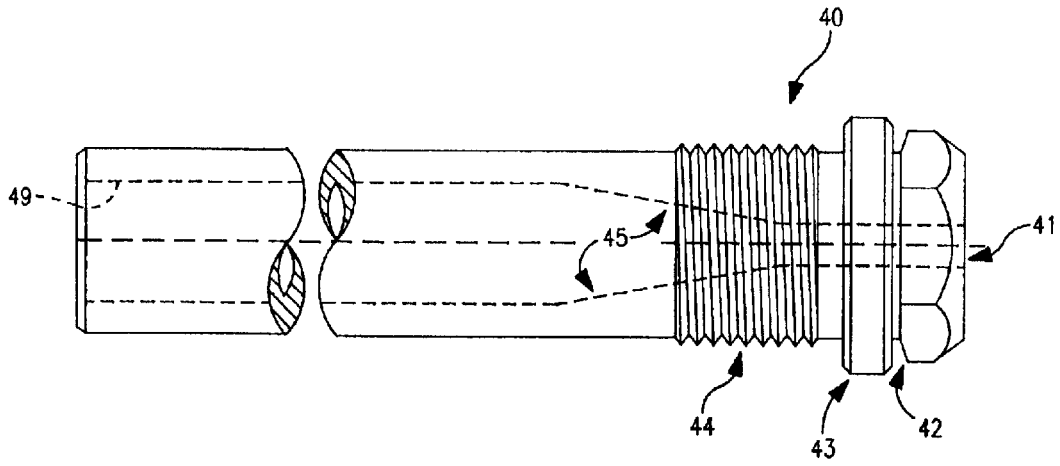
FIG. 8 is a side view of a ceramic flow reducer used in the pressure reducing valve shown in FIG. 2.

As shown in FIG. 2, pressure reducer 40 is situated in downstream channel 17 and projects into direction changing cavity 16. Referring now to FIG. 8, there is shown a preferred arrangement for the pressure reducer 40. The pressure reducer 40 is generally cylindrical and has an outside diameter that is substantially commensurate with the inside diameter of downstream liner 80. A series of screw threads 44 are formed on the outer surface adjacent the shoulder 43. The pressure reducer 40 is formed of a ceramic material. A central channel 45 extends longitudinally through the body of the pressure reducer 40 from entry port 41 to an outlet port 49. The central channel 45 flares to a larger inside diameter to provide a pressure reducing effect as the oil flows from entry port 41 through the central channel. When the pressure reducer 40 is threaded into the downstream channel 17, sealing shoulder 43 presses against a washer or gasket to provide a fluid-tight seal against the abrasive flow of oil and sand from direction changing cavity 16. The washer or gasket is preferably formed of Buena-N gasket material or an equivalent thereof.

Figure 9:
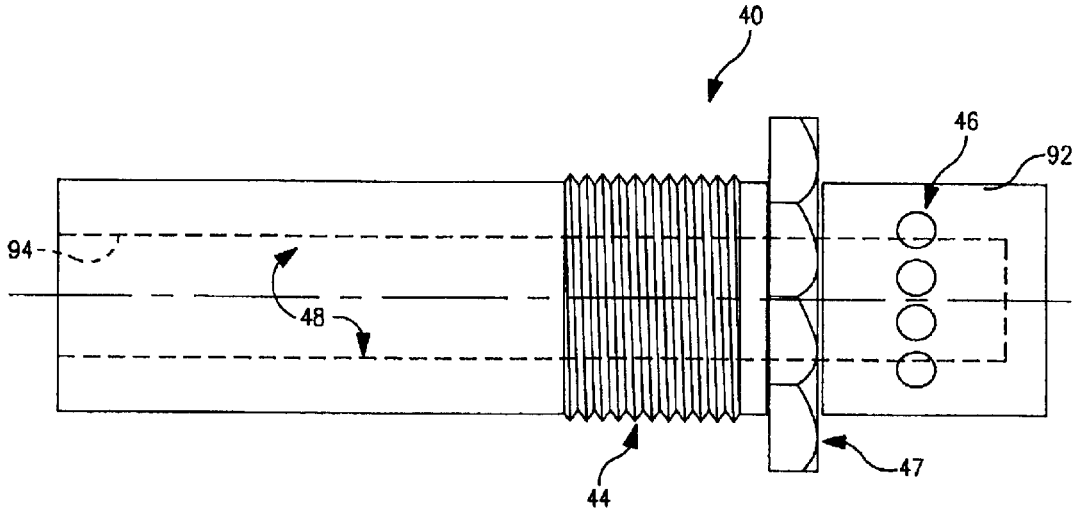
FIG. 9 is a side view of an alternative embodiment of the ceramic flow reducer shown in FIG. 8.

FIG. 9 shows a second alternative embodiment of pressure reducer 40. The embodiment shown in FIG. 9 has a generally cylindrical body including a head portion 92 with a plurality of entry holes 46 formed therein to provide an inlet for the oil. The pressure reducer 40 has a central channel 48 formed longitudinally therethrough. The central channel 48 has a substantially uniform cross section along its length and extends from the head portion 92 to an outlet port 94 in the other end of the pressure reducer 40. The entry holes 46 are in fluid communication with the central channel 48. A hexagonal shoulder 47 is formed about the circumference of the pressure reducer 40 adjacent the head portion 92. The hexagonal shoulder 47 performs the functions of the hex head 42 and shoulder 43 of the embodiment shown in FIG. 8.

Referring back to FIG. 2, upstream cylindrical liner 50 and downstream cylindrical liner 80 are removed by un-bolting flange connections at both ends of reducing valve 10, removing reducing valve 10 from the process piping, and sliding upstream cylindrical liner 50 and downstream cylindrical liner 80 out of upstream canal 11 and downstream canal 17, respectively. The liners are installed by reversing this process.

Figure 10:
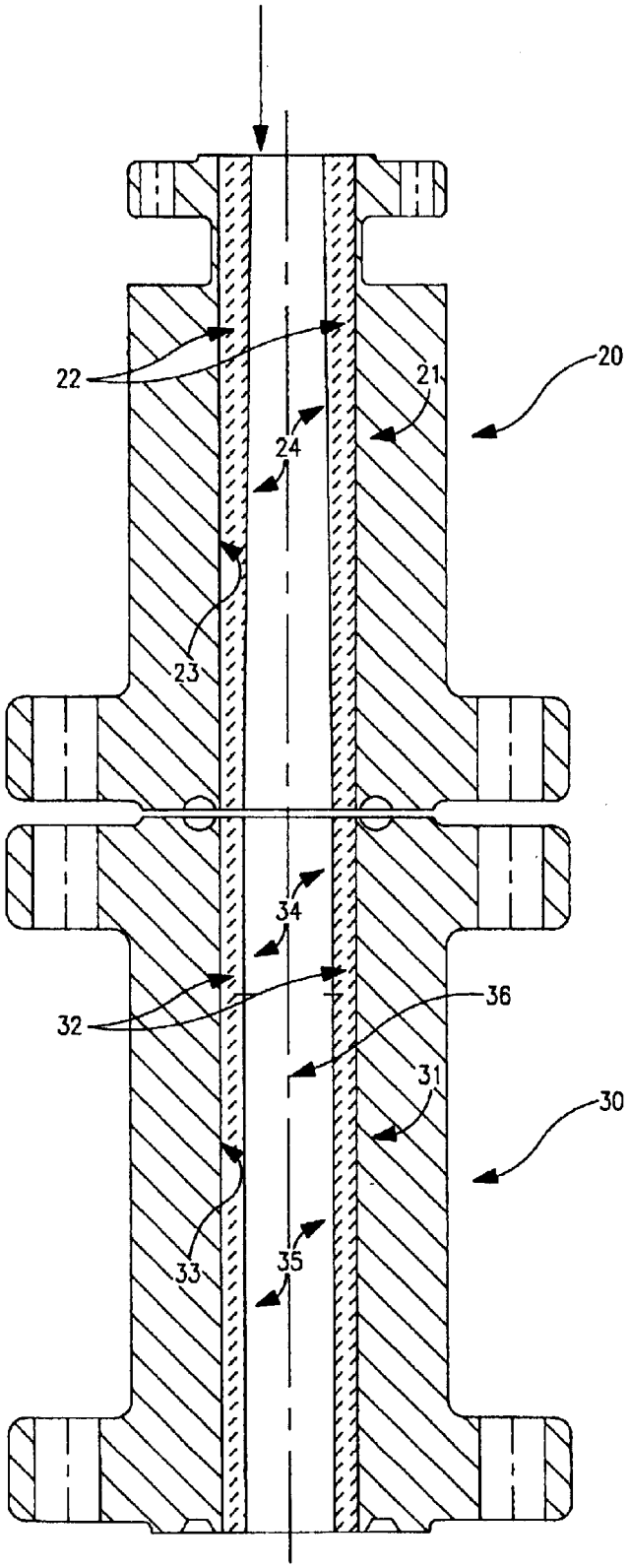
FIG. 10 is a side elevational view in cross section showing a spool adapter assembly used in the pressure reducing assembly of FIG. 1 as viewed along line 10—10 thereof.

Referring now to FIG. 10, there is shown a spool assembly including a first spool adapter 20 and second spool adapter 30. First spool adapter 20 has a steel body with a central longitudinal channel 21 having a substantially uniform cross section along the length thereof. A ceramic channel liner 22 having a substantially uniform outside diameter 23 that is dimensioned to provide a light press fit in the central channel 21 of first spool adapter 20. The ceramic channel liner 22 extends substantially the entire length of the central channel 21. Channel liner 22 has a flow channel 24 that extends the length of the channel liner 22. The cross section of the flow channel 24 gradually widens in the direction of the oil flow from the inlet of the spool adapter 20 adjacent the pressure reducing valve 10 to its outlet adjacent the second spool adapter 30. The gradual widening or flaring of the flow channel 24 minimizes turbulent, abrasive, flow that would aggravate the wear and erosion caused by the flow of oil and sand therethrough, thus increasing the useful life of the spool adapter 20.

The second spool adapter 30 has a steel body with a central longitudinal channel 31. A ceramic channel liner 32 has a substantially uniform outside diameter 33 that is dimensioned to provide a light press fit in the central channel 31 of second spool adapter 30. Ceramic channel liner 32 has a flow channel 36 that extends from the inlet adjacent the first spool adapter to the outlet adjacent the downstream process piping (not shown). The central channel 36 has a flared portion 34 and a uniform cross section portion 35. The flared portion 34 extends from the inlet along part of the length of ceramic liner 32. The degree of flaring is such as to continue the flaring of the flow channel 24 of the first spool adapter 20. The inside diameter of the uniform cross section portion 35 is dimensioned to be commensurate with the inside diameter of the downstream process piping.

As described above, the pressure reducer 40, upstream channel liner 50, direction changing cavity liner 60, key plate liner 70, downstream channel liner 80, and the central longitudinal channel liners 22 and 32, are all formed of a ceramic material. The ceramic material is selected from the class of technical ceramics, particularly technical ceramic materials that exhibit superior wear resistance and strength. Among the preferred ceramic materials are aluminum oxide (alumina), chromium oxide, high alumina, titanium oxide (titania), zirconium oxide (zirconia) ceramics, including fully and partially stabilized zirconia, and combinations of such metal oxides. It is believed that just about any type of metal-oxide ceramic will provide acceptable properties. Excellent results have been achieved using partially stabilized zirconia (PSZ) for making the aforesaid components. Particular species of PSZ that are believed to be useful for the aforesaid components include Mg-PSZ and vitreous PSZ. Silicon nitride, quartz, and silicon carbide ceramics are also expected to be useful in such components.

Figure 11:
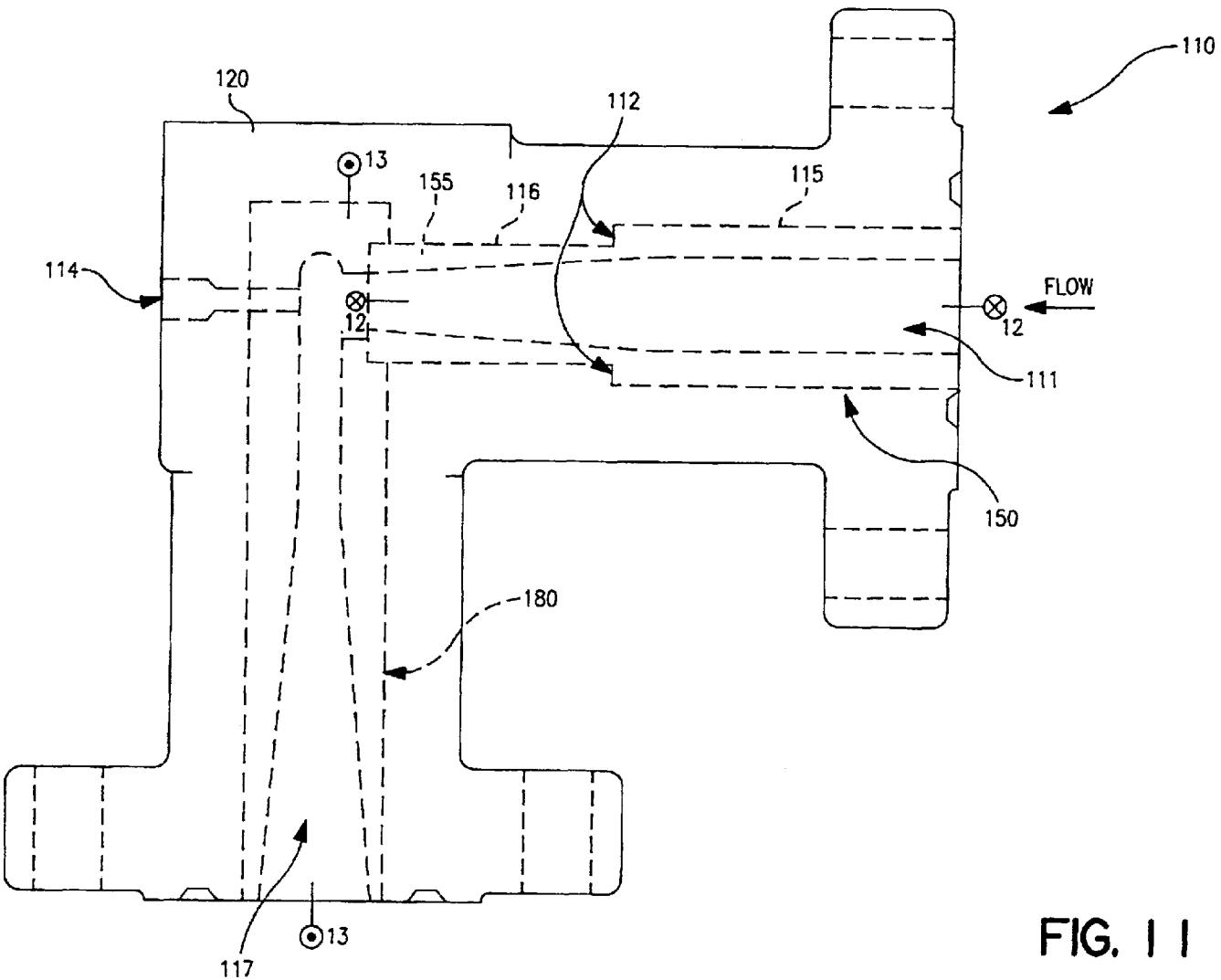
FIG. 11 is a side elevation view of an alternative embodiment of a pressure reducing valve according to the present invention.

Referring now to FIG. 11, there is shown an alternative embodiment of a pressure reducing valve according to the present invention. The pressure reducing valve 110 has a metallic body 120 that includes an upstream channel 111 and a downstream channel 117. Upstream channel 111 has an inlet portion 115 and an outlet portion 116 which meet at a maintenance point 112. An upstream channel liner 150 is disposed in the upstream channel 111, and likewise, a downstream channel liner 180 is disposed in the downstream channel 117. Channel liners 150 and 180, among other things, prevent erosion of the inner walls of the channels 111 and 117, respectively, by the oil/sand mixture flowing through pressure reducing valve 110, from the oil well. A gauge port 114 is formed in the metallic body 120 to provide a connection point for a pressure gauge, or other sensing device. Gauge port 114 has one end in communication with downstream channel 117.

Figure 12:
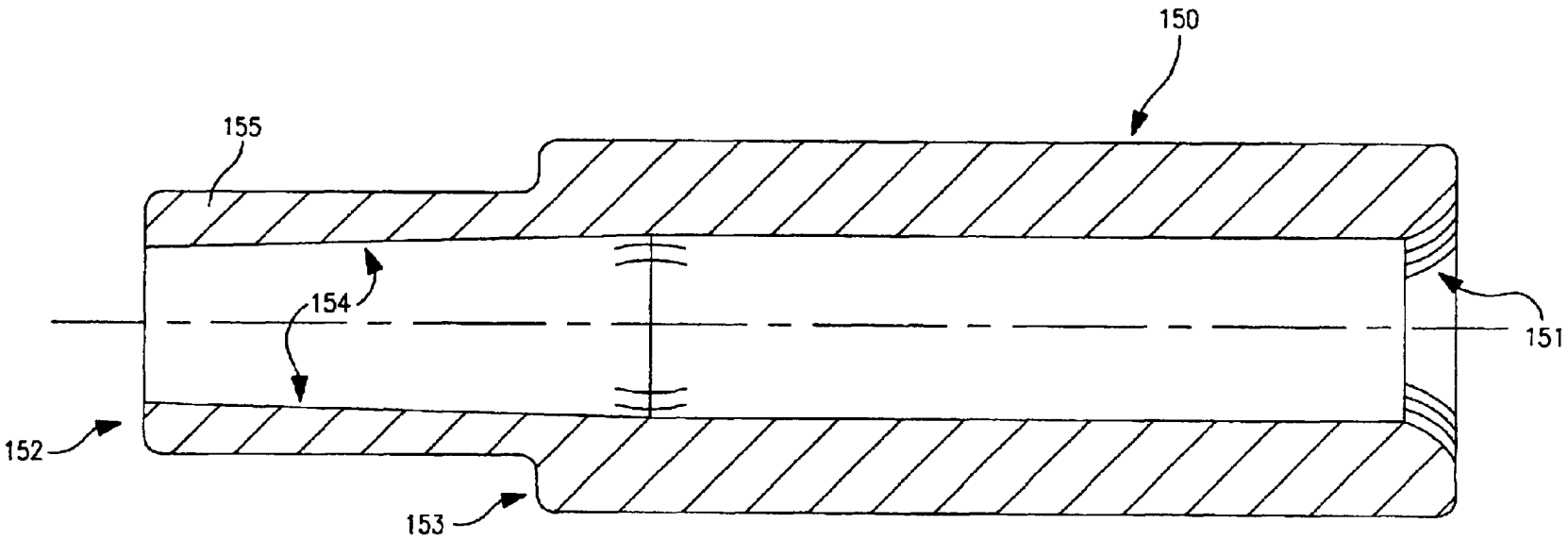
FIG. 12 is a cross-sectional side view of a ceramic liner used in the upstream channel of the pressure reducing valve of FIG. 11, as viewed along line 12—12 thereof.

Upstream channel liner 150 is slidably disposed within upstream channel 111. As shown in FIG. 12, the upstream channel liner 150 is generally cylindrical and has an inlet portion 151, which is characterized by a first diameter, and an outlet portion 152, which is characterized by a second diameter smaller than the first diameter. Inlet portion 151 has an outside diameter that is essentially commensurate with the inside diameter of the inlet portion 115 of upstream channel 111 and the outlet portion 152 has an outside diameter that is essentially commensurate with the inside diameter of the outlet portion 116 of upstream channel 111. That arrangement provides a shoulder 153 which abuts the maintenance point 112 when channel liner 150 is inserted into upstream channel 111. The abutment of shoulder 153 with maintenance point 112 prevents the liner 150 from shifting toward downstream liner 180 when oil is flowing through reducing valve 110. The upstream channel liner 150 has an internal channel 154 that extends from the inlet portion 151 to the outlet portion 152. Channel 154 is preferably tapered to lessen flow turbulence as oil flows through upstream channel liner 150. In the embodiment shown in FIG. 12, the internal channel tapers to a smaller cross section as it traverses to the outlet portion 152. The upstream channel liner 150 is preferably formed of a ceramic material as described above.

Figure 13:
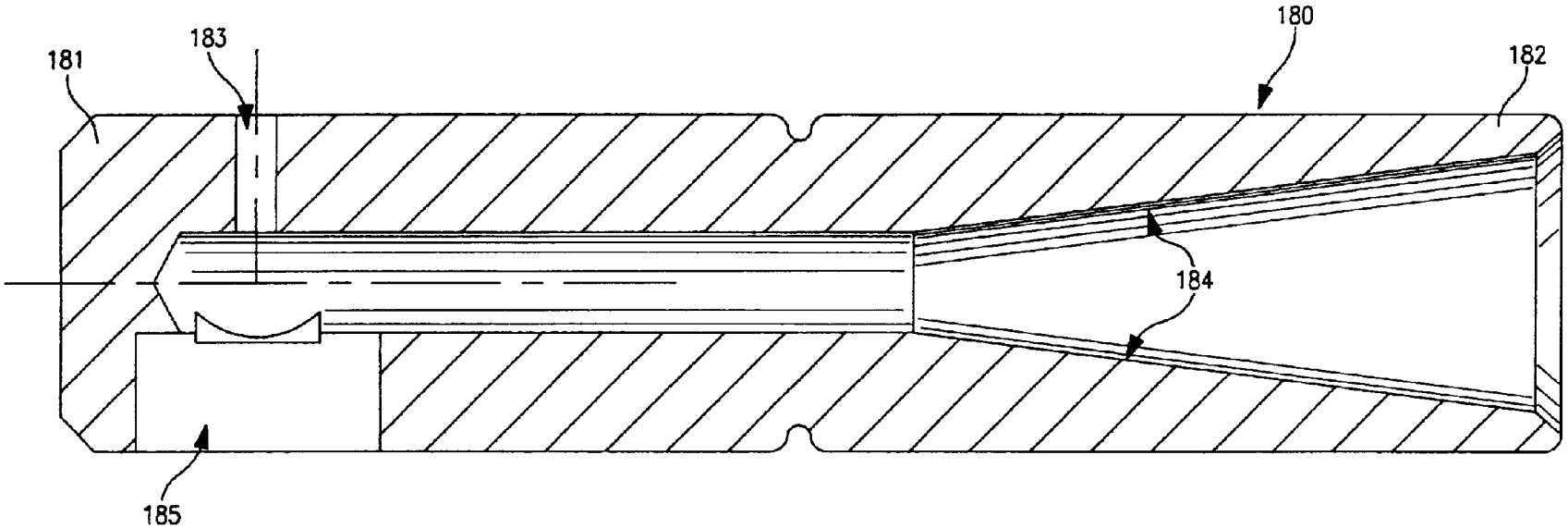
FIG. 13 is a cross-sectional view of a downstream liner used in the pressure reducing valve of FIG. 11, as viewed along line 13—13 thereof.

Downstream channel liner 180 is slidably disposed in the downstream channel 117, as shown in FIG. 11. Referring now to FIG. 13, downstream channel liner 180 is generally cylindrical and has an inlet end 181 and an outlet end 182. Downstream channel liner 180 has a through-hole 183, which is oriented and positioned to align with gauge port 114. Through-hole 183 extends radially through channel liner 180 and is in fluid communication with internal channel 184 of the channel liner 180. A recess 185 is formed in liner 180, at the inlet end 181. Recess 185 is generally cylindrical in shape and is dimensioned and positioned to receive the inner end 155 of upstream liner 150. Channel 184 extends between the inlet end 181 and the outlet end 182 of liner 180. Channel 184 is flared near outlet end 182 to minimize turbulent flow that would aggravate the wear and erosion caused by the flow of oil and sand. Downstream channel liner 180 is preferably formed of a ceramic material as described above.

In connection with this embodiment of the invention, a pressure reducing valve has been described which has only upstream and downstream ceramic liners. These ceramic liners are slidably disposed in the fluid flow channels of the pressure reducing valve assembly to protect the metallic walls of the channels from erosive wear. Furthermore, the pressure reducing valve of this embodiment has fewer components than the first-described embodiment and thus, is easier to assemble and disassemble. The upstream liner interconnects with the downstream liner, so as to keep them both securely in place.

Referring now to FIGS. 14–21, a third embodiment of a pressure reducing assembly according to the present invention is shown and designated generally as 220. The pressure reducing assembly 220 utilizes a fixed choke to reduce pressure and flow characteristics in the oil line. As in the previously described embodiments, the pressure reducing assembly 220 has internal liners and components formed of a ceramic material to provide resistance to wear from sand and other debris in the oil. The pressure reducing assembly 220 may utilize a variety of liner configurations, including but not limited to, the liners described in the other embodiments. The pressure reducing assembly 220 has a hollow metallic body 222 that forms a direction changing cavity 228 having a central flow channel. The transverse cross section of the direction changing cavity 228 can be reconfigured by the use of a combination of ceramic sleeves inserted in the flow channel. The inner sleeves have different size internal channels and are interchangeable so that the pressure and oil flow through the pressure reducing assembly 220 can be modified by using the appropriate size channel. The pressure reducing assembly 220 may also be used with no inner sleeve in the direction changing cavity 228.

The pressure reducing assembly 220 provides an inexpensive mechanism for adjusting pressure and oil flow. The inner sleeves also serve to protect the interior of the components from erosion and wear. By replacing inner sleeves periodically, the operating life of the pressure reducing assembly 220 can be extended indefinitely. The pressure reducing assembly 220 is less expensive than a conventional variable choke valve, and only requires replacement of the inner sleeves. The inner sleeves may be removed and replaced in the field in a relatively short amount of time without disconnecting the entire pressure reducer from the oil piping.

Figure 14:
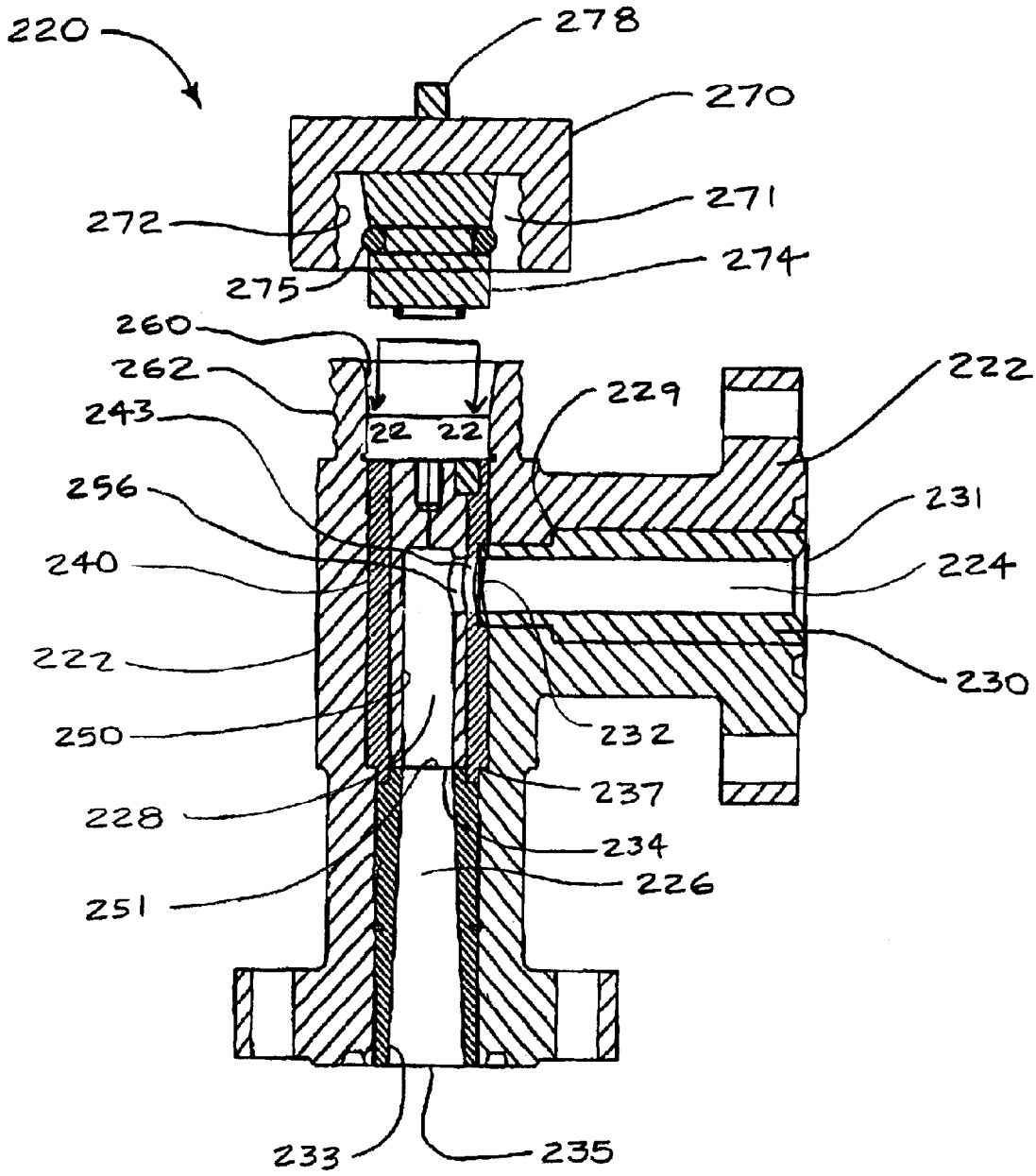
FIG. 14 is a partially exploded cross-sectional view of an alternate embodiment of a pressure reducing assembly in accordance with the present invention.

Referring to FIG. 14, the metallic body 222 has an upstream channel 224 and a downstream channel 226. The body 222 may be formed of any durable material such as steel. Oil enters the body 222 through the upstream channel 224 and passes through the direction changing cavity 228 before exiting through the downstream channel 226. An inlet liner 230 formed of ceramic material is situated in the upstream channel 224. Similarly, an outlet liner 233 formed of ceramic material is positioned in the downstream channel 226. The inlet and outlet liners 230, 233 provide barriers that prevent erosion of the inner walls of the upstream and downstream channels 224, 226 by the oil/sand mixture flowing from the oil well.

Figure 15:
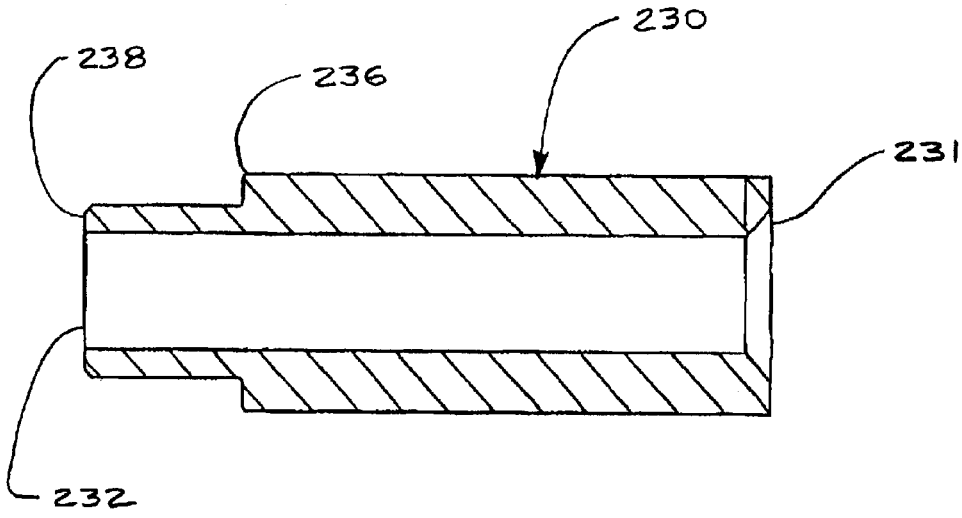
FIG. 15 is a cross-sectional view of an inlet liner used in the pressure reducing assembly of FIG. 14.

The upstream channel 224 is generally cylindrical and has a first channel section and a second channel section adjacent to the first section. The first and second channel sections have different diameters. As such, the first and second channel sections join to form an annular shoulder 229 in the upstream channel 224, as shown in FIG. 14. Referring to FIG. 15, the inlet liner 230 has a reduced outer diameter at one end that forms a circumferential ridge 236. The ridge 236 is configured to engage or abut the annular shoulder 229 in the upstream channel 224 when the inlet liner 230 is inserted in the upstream channel. The engagement between the ridge 236 and shoulder 229 provides a stop that prevents the inlet liner 230 from shifting toward the direction changing cavity 228 in response to fluid pressure exerted from the flowing oil. As in previous embodiments, the inlet liner 230 preferably has a flared internal opening to reduce flow turbulence as the oil enters the inlet liner.

Figure 16:
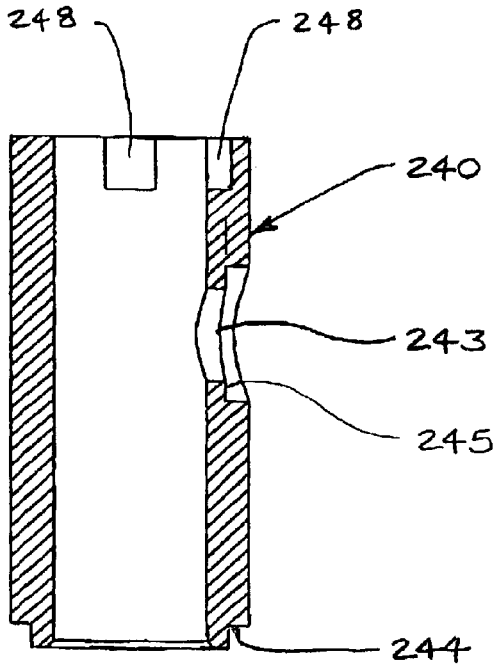
FIG. 16 is a cross-sectional view of an outer sleeve used in a central flow channel in the pressure reducing assembly of FIG. 14.

The direction changing cavity 228 is protected from erosion and wear by a ceramic outer sleeve 240. The outer sleeve 240 is configured to hold an inner sleeve formed of ceramic material. In FIG. 14, the pressure reducing assembly 220 is shown with an inner sleeve 250 inserted in the outer sleeve 240. The inner sleeve 250 forms a constriction that reduces the pressure and controls the flow through the pressure reducing assembly 220. The direction changing cavity 228 has a larger diameter than the diameter of the downstream channel 226. Therefore, the transition between the direction changing cavity 228 and downstream channel 226 forms an annular shoulder 237. Referring now to FIG. 16, the outer sleeve 240 has a circumferential groove 244 configured to engage or abut the annular shoulder 237 between the direction changing cavity 228 and downstream channel 226. The engagement between the groove 244 and the annular shoulder 237 provides a stop that prevents the outer sleeve 240 from shifting toward the outlet liner 233 in response to fluid pressure exerted by the flowing oil.

Referring now to FIGS. 14 and 16, the inlet liner 230 has a first open end 231 that receives oil from the oil well and a second open end 232 that aligns with a side port 243 in the outer sleeve 240. The inner sleeve 250 also has a side port 256 configured to align with the side port 243 in the outer sleeve 240 when the inner sleeve is inserted into the outer sleeve. When the inner sleeve 250 is inserted into the outer sleeve 240, and the side ports 243, 256 are aligned with the second open end 232 of the inlet liner 230, the upstream channel 224 and direction changing cavity 228 are connected. The inlet liner 230 connects with the outer sleeve 240 at an approximate ninety degree angle to change the direction of flow in the pressure reducing assembly 220. The side port 243 in the outer sleeve 240 has an enlarged diameter bore adjacent to a smaller diameter bore, as shown in FIG. 16. The transition between the large bore and the smaller bore forms an annular lip 245. Referring to FIG. 15, the inlet liner 230 has a circumferential rim 238 configured to engage the lip 245 formed in the outer sleeve. The rim 238 and lip 245 engage to form a fluid tight seal that limits backwash of oil through the gap between the inlet liner and outer sleeve. This reduces the potential for oil to seep past the inlet liner where it can contact and erode the wall in the inlet bore.

Figure 22:
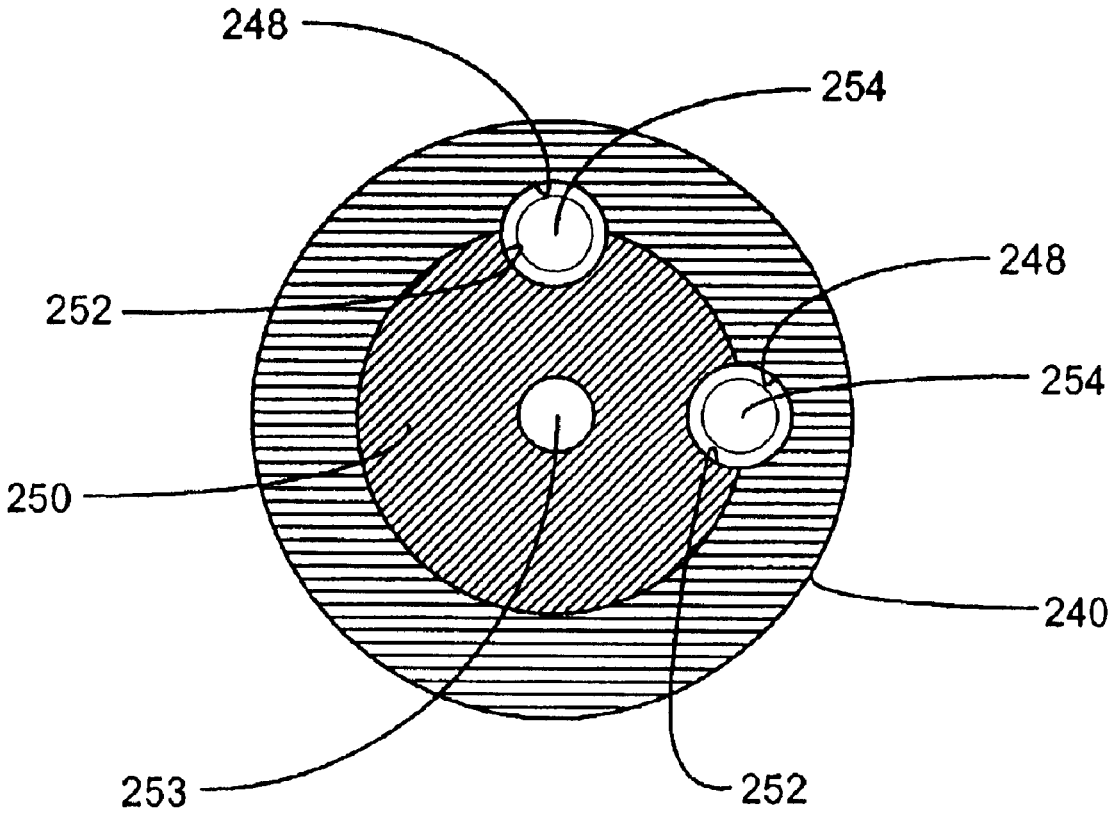
FIG. 22 is a top plan view of an inner sleeve and outer sleeve used in the pressure reducing assembly of FIG. 14.

Radial alignment of the side ports 243, 256 in the inner and outer sleeves 240, 250 is maintained by a pair of pin connections that limit rotation of the inner sleeve relative to the outer sleeve. Referring now to FIGS. 14 and 22, the outer sleeve 240 has a pair of semi-circular slots 248 that extend axially along a portion of the interior of the outer sleeve. The inner sleeve 250 has a pair of corresponding semi-circular slots 252 that extend axially along a portion of the exterior of the inner sleeve. The semi-circular slots 248, 252 are offset from one another by 90 degrees and align with one another when the side port 256 on the inner sleeve is aligned with the side port 243 in the outer sleeve 240. Once a semi-circular slot 248 on the outer sleeve 240 is aligned with a corresponding slot 252 on the inner sleeve 250, the slots form a pair of cylindrical recesses. Pins 254 are shaped to fit into the recesses to prevent rotation of the inner sleeve relative to the outer sleeve. The pins 254 are preferably formed of stainless steel. In addition, the pins 254 may be secured in the recesses using an adhesive.

Figure 17:
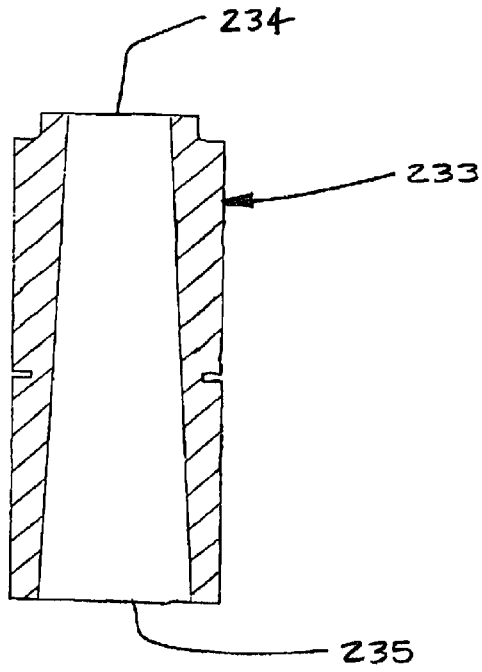
FIG. 17 is a cross-sectional view of an outlet liner used in the pressure reducing assembly of FIG. 14.

The inner sleeve 250 is generally cylindrical and aligns coaxially with the outlet liner 233, as shown in FIG. 14. The inner sleeve 250 has a first open end 251 that aligns with a first open end 234 on the outlet liner 233. Referring to FIG. 17, the outlet liner 233 has a second open end 235 through which oil discharges from the pressure reducing assembly 220 to the downstream processing equipment.

Figure 18:
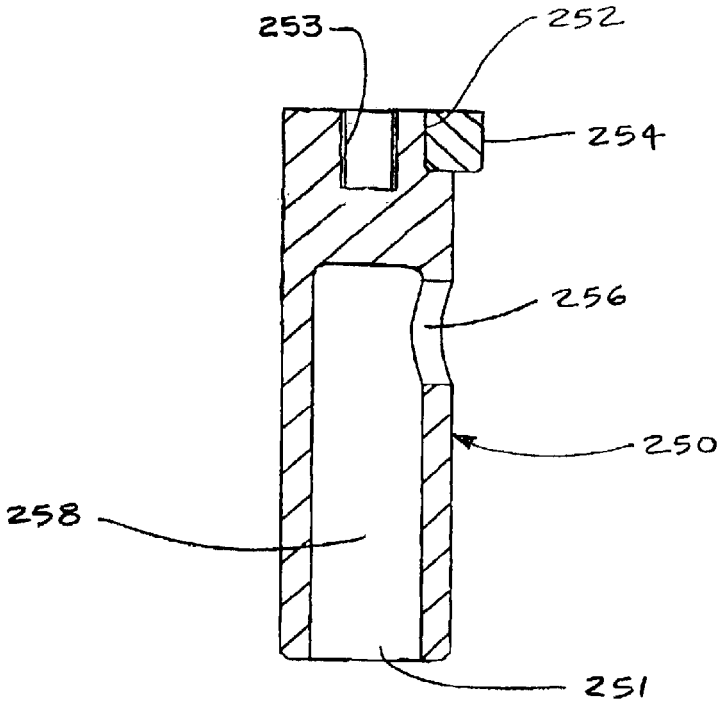
FIG. 18 is a cross-sectional view of a first inner sleeve used in a central flow channel in the pressure reducing assembly of FIG. 14.

The pressure reducing assembly 220 is intended for use with a variety of interchangeable inner sleeves to modify the pressure and flow characteristics in the device. Each inner sleeve has an interior orifice configured to restrict flow and reduce the pressure of oil flowing through the pressure reducing assembly 220. In FIG. 18, the inner sleeve 250 has an interior orifice 258 of uniform diameter. The diameter of the orifice 258 is generally less than the inner diameter of the piping from the well head, forming a constriction. Oil enters the inner sleeve 250 through the side port 256, flows through the orifice 258 and exits through the first open end 251 of the inner sleeve.

Referring to FIGS. 14 and 22, inner sleeve 250 has a cylindrical bore 253 that permits the inner sleeve to be easily removed from the outer sleeve 240. In the preferred embodiment, the bore 253 contains a plurality of threads that may be engaged by threads on a variety of tools. A removal tool is inserted into the bore 253 and rotated so that the threads on the tool engage the threads in the bore. The removal tool may then be pulled out of the direction changing cavity 228 to remove the inner sleeve 250 from the outer sleeve 240.

Figure 19:
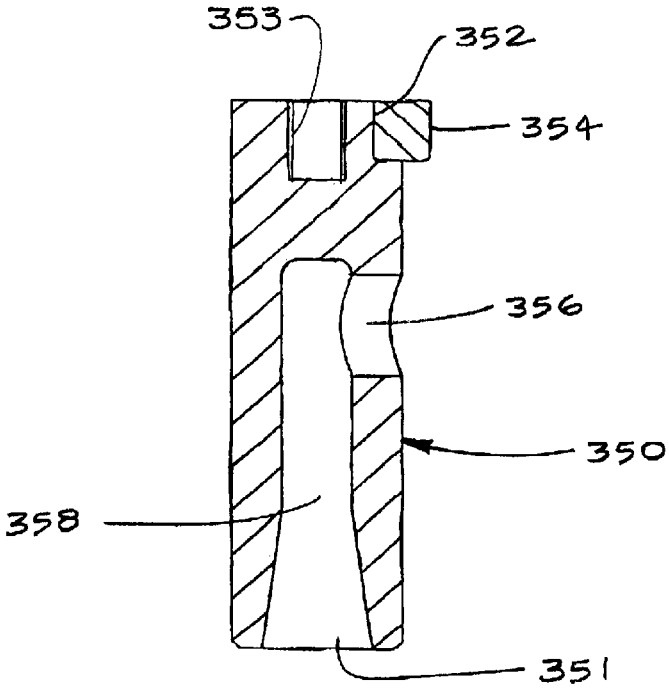
FIG. 19 is a cross-sectional view of a second inner sleeve used in the pressure reducing assembly of FIG. 14.
Figure 20:
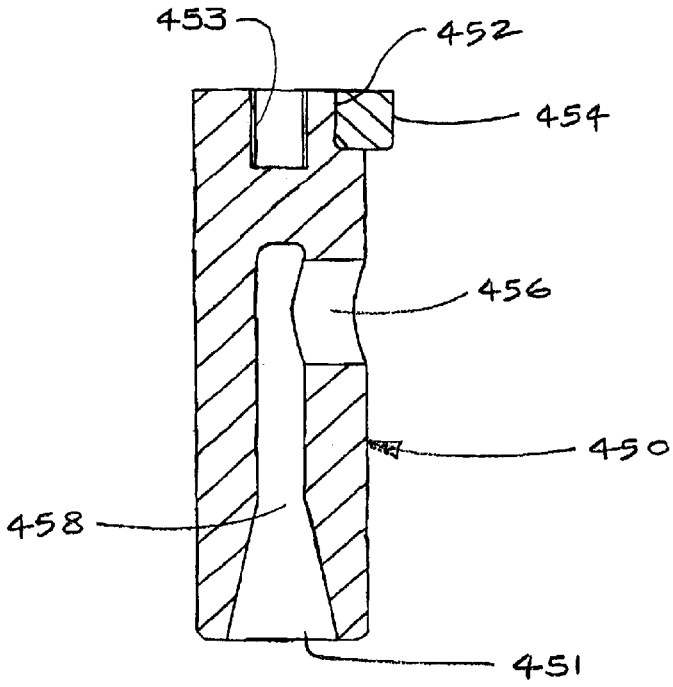
FIG. 20 is a cross-sectional view of a third inner sleeve used in the pressure reducing assembly of FIG. 14.
Figure 21:
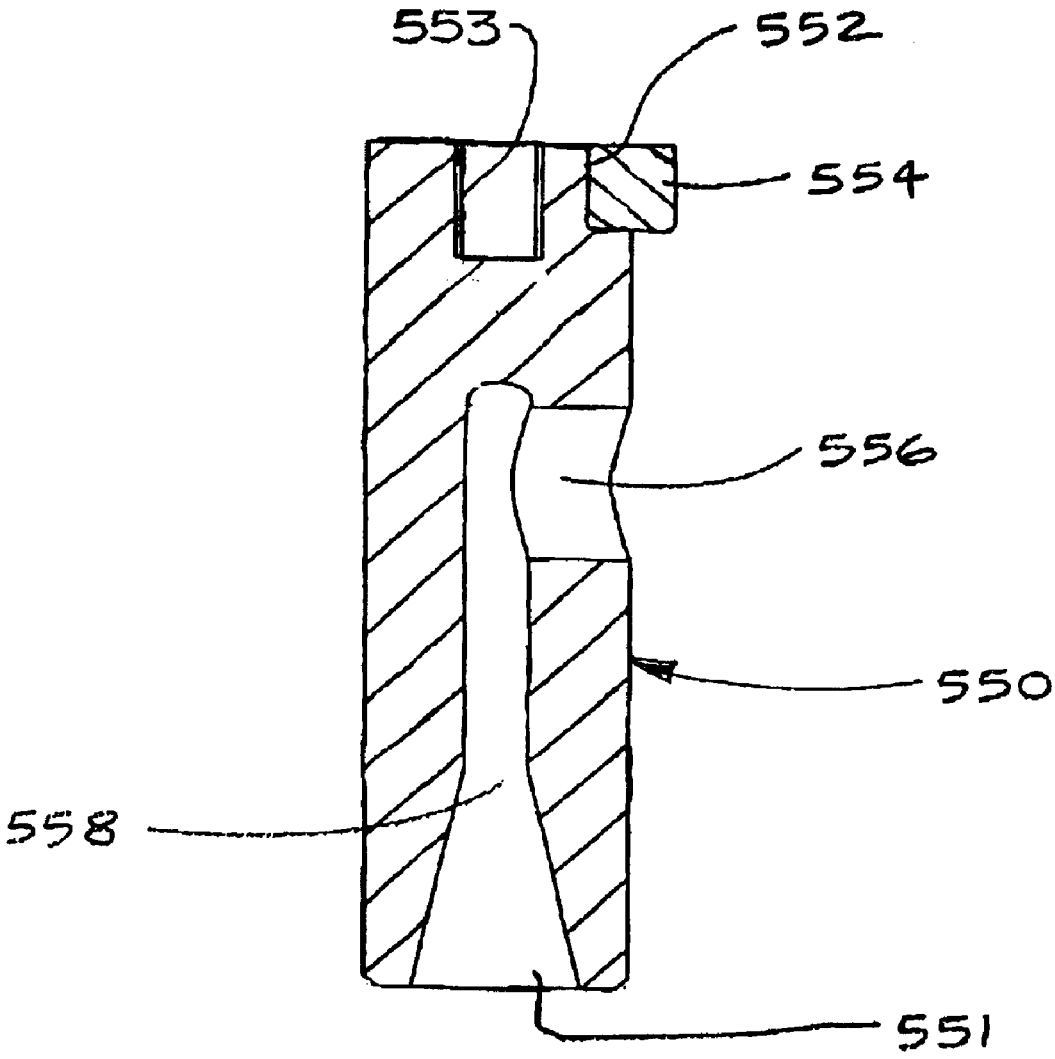
FIG. 21 is a cross-sectional view of a fourth inner sleeve used in the pressure reducing assembly of FIG. 14.

To modify the pressure and flow of oil in the pressure reducing assembly 220, the inner sleeve 250 is removed from the outer sleeve 240 and replaced with another inner sleeve having a different orifice. FIGS. 19–21 illustrate inner sleeves 350, 450 and 550 that feature different orifice configurations. Elements on sleeves 350, 450 and 550 that correspond to elements on sleeve 250 are referenced by the same number plus 100, 200 and 300 respectively. Unlike inner sleeve 250, the sleeves 350, 450 and 550 have inner diameters that vary along the axial length of the sleeve. Each of the sleeves 350, 450 and 550 has a central throat section with a reduced diameter. The diameter of the orifice gradually increases from the throat section to the first open end of the inner sleeve. Referring to FIG. 21, sleeve 550 is shown with a throat diameter smaller than the inner diameters of the sleeve 250, 350 and 450. As such, sleeve 550 provides greater pressure reduction than the other sleeves.

Referring again to FIG. 14, the body 222 has an access port 260 that permits access to the direction changing cavity 228. The access port 260 is configured to permit an operator to remove and install inner sleeves in the pressure reducing assembly 220 while the device remains connected in line with oil piping. In this way, the flow and pressure characteristics of the choke device can be modified without disconnecting the device from the oil piping. An end cap 270 connects to the body 222 to cover and seal the access port 260 while oil flows through the pressure reducing assembly 220. The end cap 270 may be secured to the body 222 using a variety of connections. In FIG. 14, the end cap 270 forms a cylindrical recess 271 that fits over the access port 260. The recess 271 has a series of internal threads 272 configured to engage a series of external threads 262 on the access port 260. When the threads 272 on the end cap are aligned with the threads 262 on the access port 260, the end cap 270 may be rotated to open and close the access port.

The end cap 270 has a generally cylindrical plug 274 that extends into the access port 260 when the cap is placed over the access port. The plug 274 is configured to engage the inner sleeve 250 when the threads 262, 272 between the body 222 and cap 270 are engaged. The plug 274 contacts the inner and outer sleeves 240, 250 to form a fluid tight seal. In the event that oil slips between the inner and outer sleeves 240, 250, the end cap 270 and plug 274 prevent oil from exiting the access port 260 when oil flows through the pressure reducing assembly 220. Preferably, the access port 260 is further sealed by one or more O-rings attached to the plug 274. As shown in FIG. 14, the plug 274 includes a large O-ring 275. The O-ring 275 has an outer circumference configured to sealingly engage the interior walls of the access port 260 to prevent oil from escaping the access port.

When oil flows through the pressure reducing assembly 220, the interior of the device is subject to high pressure. Before the end cap 270 can be removed from the access port 260, pressure in the pressure reducing assembly 220 must be equalized with ambient pressure. Therefore, the end cap 270 preferably has a bleed valve 278 to release pressure from the interior of the pressure reducing assembly 220. The bleed valve 278 is disposed in a conduit through the end cap. The conduit connects to the interior of the access port and operates to release pressure from the interior of the access port 260. The bleed valve 278 has threads that engage threads on the interior of the conduit. In this way, the bleed valve 278 may be rotated in the conduit to open and close the valve. When the bleed valve 278 is closed, the conduit is sealed. The bleed valve 278 may be opened to unseal the conduit and release pressure through the conduit.

It can be seen from the foregoing description and the accompanying drawings that the present invention provides a novel means for extending the operating life of high pressure oil well components and for maintaining desired operating pressures by substantially reducing the rate of abrasive wear to components in a pressure reducing assembly for a high pressure oil well head. Although the invention has been described with reference to specific components and assemblies thereof, including a ceramic pressure reducer, a ceramic-lined reducing valve, ceramic-lined spool pipe adapters, and ceramic sleeves, it is contemplated that any metal component in such a pressure reducing assembly that is subject to erosive wear caused by the flow of an oil/sand mixture under very high pressure can be formed from or lined with a ceramic material to substantially reduce the rate of wear and erosion. A distinct advantage of the present invention is that a high pressure oil well, incorporating ceramic components in accordance with this invention, can be operated at the desired high well pressures while keeping the sand content low. The desired high pressures can be maintained over a much longer period of time than obtainable with known components because component deterioration is minimized. Lost oil production resulting from well down-time, during spent component replacement, is drastically reduced, because of the increased wear resistance and more efficient flow design of the ceramic components.

It will be recognized by those skilled in the art that changes or modifications may be made to the above described embodiments without departing from the broad, inventive concepts of the invention. The terms and expressions which have been employed above are used as terms of description and not of limitation. There is no intention in the use of such terms and expressions of excluding any equivalents of the features shown and described or portions thereof. Accordingly, the invention incorporates variations that fall within the scope of the following claims.

We claim:

1. A pressure reducing assembly for a high pressure well comprising a housing formed of a metallic material, said housing having an upstream channel, a downstream channel, and a central channel that interconnect with each other;

a first ceramic liner disposed in said upstream channel for lining the internal surface of said upstream channel;

a second ceramic liner disposed in said downstream channel for lining the internal surface of the downstream channel;

a third ceramic liner disposed in said central channel for lining the internal surface of the central channel, said third ceramic liner having an orifice formed therein that is positioned and dimensioned to align substantially coaxially with said first ceramic liner for providing a flow path between said upstream channel and said central channel;

a ceramic pressure reducing insert disposed in said third ceramic liner, said ceramic pressure reducing insert having an inlet orifice formed therein that is aligned substantially coaxially with the orifice in said third ceramic liner and being fixed against axial and rotational movement relative to said third ceramic liner; and means for providing access to said central channel to facilitate insertion or removal of said third ceramic liner and said ceramic pressure reducing insert.

2. A pressure reducing assembly as set forth in claim 1, wherein said ceramic pressure reducing insert comprises:

an outlet orifice; and an internal channel that extends coaxially with said third ceramic liner substantially from said inlet orifice to the outlet orifice, said internal channel having a reduced cross-sectional dimension relative to said third ceramic liner so that fluid flow through said internal channel can be substantially reduced relative to said inlet channel, thereby reducing the fluid pressure.

3. A pressure reducing assembly as set forth in any of claims 1 and 2, wherein said first, second, and third ceramic liners, and said ceramic pressure reducing insert are formed of a technical ceramic material selected from the group consisting of alumina, chromium oxide, titania, zirconia, partially stabilized zirconia, silicon nitride, silicon carbide, and combinations thereof.

4. A pressure reducing assembly for a high pressure well as set forth in claim 1 comprising a coupling configured for connecting said pressure reducing insert with said third ceramic liner in a locked position whereby the ceramic pressure reducing insert is restrained against rotation relative to the third ceramic liner, and means for providing access to said central channel to facilitate insertion or removal of said third ceramic liner and insert.

5. A pressure reducing assembly for a high pressure well comprising a housing formed of a metallic material, said housing having an upstream channel, a downstream channel, and a central channel that interconnect with each other;

a first ceramic liner disposed in said upstream channel for lining the internal surface of said upstream channel;

a second ceramic liner disposed in said downstream channel for lining the internal surface of said downstream channel;

a third ceramic liner disposed in said central channel for lining the internal surface of the central channel, said third ceramic liner having an orifice formed therein that is positioned and dimensioned to align substantially coaxially with said first ceramic liner for providing a flow path between said upstream channel and said central channel;

means for providing access to said central channel to facilitate insertion or removal of said third ceramic liner, and a plurality of ceramic pressure reducing inserts configured for insertion into the flow path in said third ceramic liner, each of said pressure reducing inserts having;

an inlet orifice formed therein that is positioned and dimensioned to align substantially coaxially with the orifice in said third ceramic liner;

an outlet orifice; and an internal channel that extends substantially from said inlet orifice to the outlet orifice, said internal channel having a reduced cross-sectional dimension relative to said third ceramic liner so that fluid flow through said internal channel can be substantially reduced relative to said inlet channel, thereby reducing the fluid pressure, wherein each insert has an internal channel configuration that is distinct from the other inserts, said inserts being configured for selective placement in the flow path to provide a desired amount of fluid pressure reduction.

6. A pressure reducing assembly for a high pressure well as set forth in claim 5 wherein said first, second, and third ceramic liners, and said ceramic pressure reducing inserts are formed of a technical ceramic material selected from the group consisting of alumina, chromium oxide, titania, zirconia, partially stabilized zirconia, silicon nitride, silicon carbide, and combinations thereof.

7. A pressure reducing assembly, comprising:

A. a hollow body having an upstream channel, a downstream channel and a central flow channel between the upstream channel and the downstream channel;

B. a first liner disposed in the upstream channel;

C. a second liner disposed in the downstream channel;

D. an outer sleeve disposed in the central flow channel and having an internal bore; and E. a first inner sleeve disposed in the internal bore of the outer sleeve and having a first internal configuration; and F. a locking pin removably coupled with the first inner sleeve and the outer sleeve to connect the first inner sleeve with the outer sleeve, wherein the first inner sleeve is removable from the internal bore of the outer sleeve by removing the locking pin, said first inner sleeve being interchangeable with a second inner sleeve configured for insertion in the internal bore of the outer sleeve, said second inner sleeve having a second internal configuration.

8. The pressure reducing assembly of claim 7, wherein the first liner, second liner, outer sleeve and first inner sleeve are formed of a technical ceramic material.

9. The pressure reducing assembly of claim 7, further comprising an end cap releasably connected to the body and configured for removal from the body to provide access to the internal bore of the outer sleeve.

10. A method for operating a pressure reducing assembly, comprising the steps of:

A. providing a pressure reducing assembly having a hollow body and a central flow channel formed therein;

B. placing a wear resistant outer sleeve formed of a ceramic material in the central flow channel;

C. inserting a first inner sleeve in the outer sleeve, said first inner sleeve being operable to discharge oil from the pressure reducing assembly at a first pressure and a first flow rate; and D. removing the first inner sleeve from the outer sleeve and replacing the first inner sleeve with a second inner sleeve, said second inner sleeve being operable to discharge oil from the pressure reducing assembly at a second pressure and a second flow rate.

11. A flow control assembly, comprising:

A. a hollow body having an upstream channel, a downstream channel, and a central flow channel between the upstream channel and the downstream channel;

B. a first liner disposed in the upstream channel;

C. a second liner disposed in the downstream channel;

D. an outer sleeve disposed in the central flow channel and having an internal bore;

E. an inner sleeve disposed in the internal bore of the outer sleeve, and

F. a coupling configured for connecting said inner sleeve with said outer sleeve such that the inner sleeve is restrained against rotation relative to the outer sleeve.

* * * * *